US005458208A

United States Patent [19]

Clarke

[11] Patent Number: 5,458,208

[45] Date of Patent: Oct. 17, 1995

[54] DIRECTIONAL DRILLING USING A ROTATING SLIDE SUB

[76] Inventor: Ralph L. Clarke, 13927 Lynnwood, Sugar Land, Tex. 77478

[21] Appl. No.: 270,747

[22] Filed: Jul. 5, 1994

[51] Int. Cl.[6] ..... E21B 47/022

[52] U.S. Cl. ..... 175/45; 175/61; 175/74; 175/107

[58] Field of Search ..... 175/40, 61, 45, 175/73–75, 107

[56] References Cited

U.S. PATENT DOCUMENTS

| | | | |
|---|---|---|---|
| 4,577,701 | 3/1986 | Dellinger et al. | 175/61 |
| 4,697,651 | 10/1987 | Dellinger | 175/76 X |
| 4,719,977 | 1/1988 | Dellinger | 175/73 X |
| 4,932,482 | 6/1990 | DeLucia | 175/75 |
| 4,962,818 | 10/1990 | DeLucia | 175/75 |
| 5,022,471 | 6/1991 | Mauer et al. | 175/75 |
| 5,094,305 | 3/1992 | Wenzel | 175/75 |
| 5,099,931 | 3/1992 | Krueger et al. | 175/75 |
| 5,139,094 | 8/1992 | Prevedel et al. | 175/73 X |
| 5,265,682 | 11/1993 | Russell et al. | 175/73 X |
| 5,318,137 | 6/1994 | Johnson et al. | 175/76 X |

*Primary Examiner*—Roger J. Schoeppel
*Attorney, Agent, or Firm*—Harrison & Egbert

[57] ABSTRACT

A method of directional drilling including the steps of affixing a bit, a motor housing, a MWD, and a sub to an end of a drillstring, forming a hole in the earth by rotating the bit as the drillstring lowers into the earth, actuating the sub such that the MWD is stationary as the drillstring rotates, and measuring a position of the bit as the MWD is stationary and as the drillstring rotates. The motor housing and the MWD are connected to the drillstring such that the MWD rotates in correspondence with the motor housing. The step of measuring includes measuring an inclination and an azimuth of the hole at the location of the MWD in the hole. A tool face orientation is adjusted relative to the position of the bit within the hole. The sub has a first portion connected to the drillstring and a second portion connected to the motor housing. The step of actuating includes indexing a gear member within the sub such that the first portion rotates independently of the second portion.

20 Claims, 4 Drawing Sheets

DIRECTIONAL DRILLING USING A ROTATING SLIDE SUB

TECHNICAL FIELD

The present invention relates to methods of directional drilling. More particularly, the present invention relates to methods of directional drilling that employ bottom hole assemblies having MWD's attached thereto. Additionally, the present invention relates to methods for taking measurements downhole as the drillstring rotates.

BACKGROUND ART

In the art of oil field drilling technology, "directional drilling" is becoming increasingly prominent. In directional drilling, the angle of the borehole is altered during the drilling operation from vertical toward horizontal. Initially, directional drilling was developed in order to explore for oil under natural barriers, such as lakes. However, it has been determined that if the borehole passes along, rather than merely vertically traverses a permeable oil bearing formation, production can be dramatically increased.

It has been recognized that a number of advantages can be gained in drilling wells by employing a stationary drill pipe or drillstring which has attached, at its lower end, a downhole motor. The drive section of the downhole motor is connected to and rotates a drill bit. In such an apparatus, a fluid (such as air, foam, or a relatively incompressible liquid) is forced down the stationary drill pipe or drillstring and on passing through the fluid-operated motor causes rotation of a shaft ultimately connected to the drilling bit. The drillstring is held or suspended in such a manner that it does not rotate and therefore may be regarded as stationary. However, it is lowered in the well as the drilling proceeds.

In directional drilling, drilling motors are utilized wherein a bend may be located in the drillstring above the motor, a bend may be placed in the motor housing below the rotor/stator drive section, or the bit or output shaft can be angularly offset relative to the drive section axis.

In typical bottom hole assemblies (BHA), the motor, the motor housing, and the bit are placed below the MWD (measurement-while-drilling) sensors. These MWD sensors include accelerometers and/or magnetometers which are positioned in the MWD so as to form part of the bottom hole assembly. These sensors in the MWD can be used so as to determine the inclination and/or azimuth of the hole. Typically, the information from the MWD is transmitted to a surface location so that the position of the bit within the well bore can be properly determined.

In directional drilling applications, it is necessary to stop the rotating of the drillstring so as to properly take a measurement from the MWD. MWD measurements are not taken as the MWD section rotates with the rotating of the drillstring. Whenever the drillstring rotation is stopped, there is a tendency for the drillstring to contact the walls of the borehole. Such contact can occur from a buckling of the drillstring caused by the downward slide of the drillstring. Alternatively, the downhole formation can collapse inwardly onto the drillstring so as to create contact forces with the surface of the drillstring. In normal operation, when the rotation of the drillstring is stopped, the bit motor causes the bit to rotate and the drillstring slides downwardly so as to move the bit downwardly in the hole. If the drillstring should become "hung up" on the sides of the borehole, then the continued lowering of the drillstring will simply cause the drillstring to buckle. Drilling progress becomes rapidly inhibited by such contacts between the drillstring and the borehole wall. When the drillstring becomes stuck, it is necessary to lift the drillstring, to a certain extent, and to also rotate the drillstring so as to free the drillstring from the contact forces.

In the past, various patents have issued relative to directional drilling operations. U.S. Pat. No. 4,932,482, issued on Jun. 12, 1990 and U.S. Pat. No. 4,962,818, issued on Oct. 16, 1990, both to F. DeLucia teach a downhole motor with an enlarged connecting rod housing. A drill bit is connected to the lower end of the downhole motor and a bent sub is attached to its upper end. The downhole motor includes a motor housing, a connecting rod housing and a bearing housing. The connecting rod housing has a bend angle formed on the housing, which is enlarged to enable the connecting rod to be tilted at a larger angle than otherwise possible.

U.S. Pat. No. 5,022,471, issued on Jun. 11, 1991, to Maurer et al. teaches a deviated wellbore drilling system suitable for drilling curved wellbores which have a radius of curvature of approximately 10 to 1,000 feet. This system includes a drillstring, a drill bit, and a fluid-operated drill motor having a curved or bent housing section for rotating the drill bit independently of the drillstring. The drilling motor has an elongate tubular rotor/stator drive section containing a rubber stator and a steel rotor and the housing is bent or curved intermediate its ends. A straight or bent universal section below the bent rotor/stator section contains a universal joint for converting orbiting motion of the rotor to concentric rotory motion at the bit. A bearing pack section below the universal section contains radial and thrust bearings to absorb the high loads applied to the bits.

U.S. Pat. No. 5,094,305, issued on Mar. 10, 1992, to K. H. Wenzel teaches an orientable adjustable bent sub having a tubular member in the form of an adjustment sleeve, with a first end offset to a primary axis so as to telescopically receive the first end of the tubular member. By rotation of the adjustment sleeve, the offset portion of the adjustment sleeve is adjusted in relation to the offset portion of the tubular member so as to produce a bend of desirable magnitude. The adjustment sleeve is axially movable between an engaged position and a disengaged position.

U.S. Pat. No. 5,099,931, issued on Mar. 31, 1992, to Krueger et al. describes a method and apparatus for optional straight hole drilling or directional drilling in earth formations. This apparatus includes a downhole drilling assembly having a drill bit driven by a downhole motor and a deflection element in the assembly for imparting an angle of deflection to the drill bit relative to drillstring above the drilling assembly. At least two stabilization points for the drilling assembly in the borehole are used, with the drill bit, to define an arcuate path for the drilling assembly when the downhole motor is operating but the drillstring is not rotating.

German Patent No. 1,235,834, published on Mar. 9, 1967, describes a turbo-drill having a fixed shaft and a rotary body. A rotor and a stator form three differently sized groups so as to make up a turbo-convertor. Soviet Patent No. 832,016, published on Nov. 15, 1978, teaches a downhole motor for drills that has straight brake rim teeth with one tooth difference between rims for higher rotative moment on an output shaft. Soviet Patent No. 829,843, published on May 4, 1969 describes a turbodrill for downhole operations. This turbodrill has a flexible fluted ring received in a round stator boss groove to prevent twisting under blade reaction.

It is an object of the present invention to provide a method which allows the drillstring to be rotated independently of measurements carried out at the MWD.

It is another object of the present invention to provide a method that minimizes contact interference with the movement of the drillstring in the wellbore.

It is another object of the present invention to provide a method that reduces instances of drillstring buckling in the wellbore.

It is a further object of the present invention to provide a method for carrying out downhole measurements which allows for the adjustment of the tool face orientation without stopping the rotation of the drillstring.

These and other objects and advantages of the present invention will become apparent from a reading of the attached specification and appended claims.

SUMMARY OF THE INVENTION

The present invention is a method of directional drilling that comprises the steps of: (1) affixing a bit, a motor housing, an MWD and a sub to an end of a drillstring; (2) forming a hole in the earth by rotating the bit as the drill string lowers into the earth; (3) actuating the sub such that the MWD is stationary as the drillstring rotates; and (4) measuring a position of the bit in the hole as the MWD is stationary and the drillstring rotates.

Within the scope of the present invention, the step of affixing includes attaching the motor housing and the MWD to the drillstring such that the MWD rotates in correspondence with the motor housing. The bit is connected to a motor within the motor housing. The method includes pumping a drilling fluid to the motor through the drillstring, and rotating the bit relative to a flow of drilling fluid in the drillstring. The step of forming a hole includes rotating the drillstring and bit as the drillstring lowers into the earth.

The step of actuating the sub includes disengaging a portion of the sub from the the drillstring such that the portion is stationary when the drillstring rotates. This portion is connected to the MWD. This is accomplished by stopping a flow of drilling fluid through the drillstring. The bit can be rotated as the MWD and the motor housing are positioned in a stationary position.

The step of measuring includes measuring an inclination and an azimuth of the hole at the location of the MWD in the hole. These measurements of the position of the bit within the hole are transmitted to a surface location. Following the receipt of the information concerning inclination and azimuth, the tool face orientation can be adjusted relative to the position of the bit within the hole. The sub can then be reactuated such that the MWD rotates with a rotation of the drillstring.

The sub has a first portion connected to the drillstring and a second portion connected to the MWD collar. The step of actuating includes indexing a gear member within the sub such that the first portion rotates independently of the second portion. The gear member can be indexed within the sub such that the second portion is stationary as the first portion and the bit rotate. The indexing is accomplished by pumping a drilling fluid into contact with a plate within the sub. The plate is movable between a first gear-engaging position and a second non-engagement position. The first portion rotates independently of the second portion when the plate is in the second position. The first portion rotates with the second portion when the plate is in the first position. The pumping serves to move the plate to the first position.

DETAILED DESCRIPTION OF THE INVENTION

Figure 1:
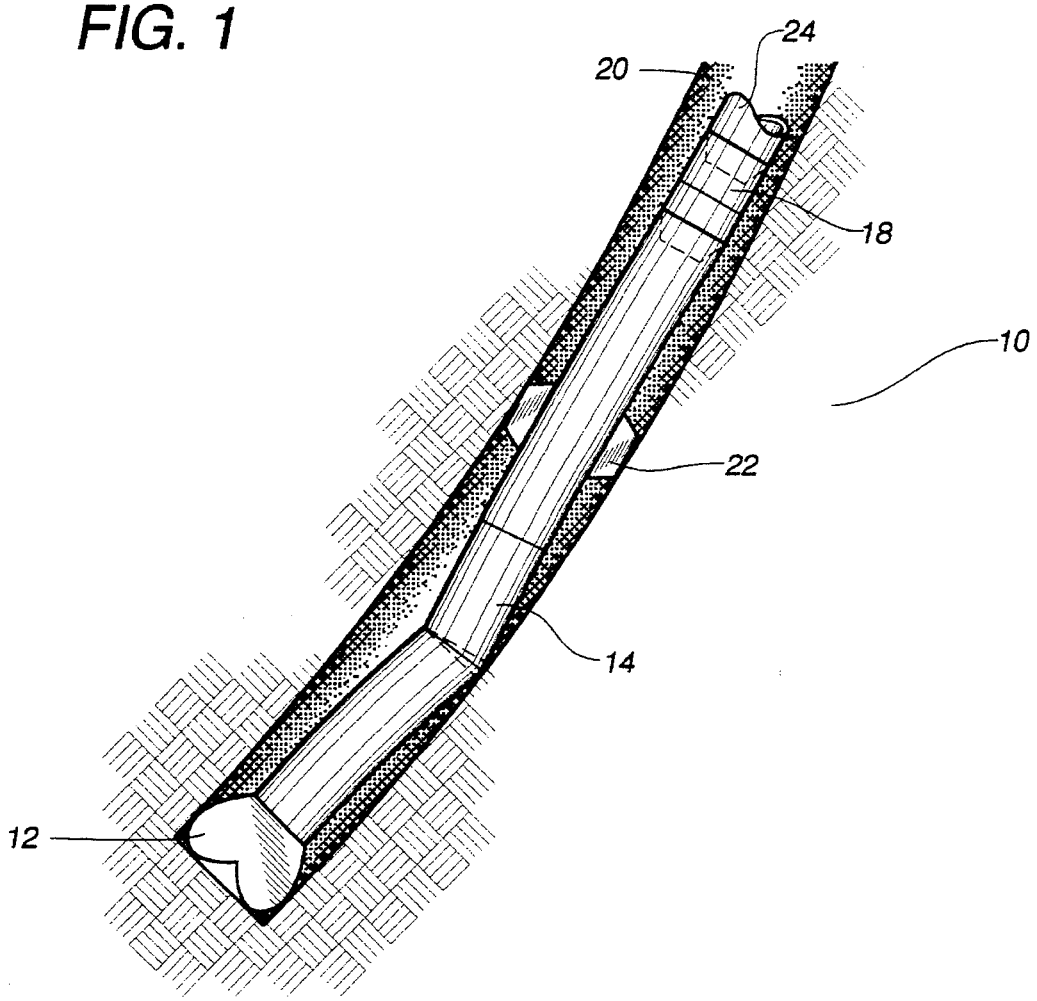
FIG. 1 is a cross-sectional side view showing the bottom hole assembly of the present invention.

FIG. 1 illustrates a bottom hole assembly 10 which is used in accordance with the method of the present invention. The bottom hole assembly 10 includes a bit 12, a downhole motor 14 having a bent housing, a MWD 16, and the rotating slide sub 18. The bit 12 is connected to a motor located within the bent housing 14. The MWD is positioned above the motor housing 14 within the borehole 20. A stabilizer 22 can be affixing to the exterior of the MWD 16 so as to centralize the MWD 16 within the borehole 20. The rotating slide sub 18 is positioned at the end of the MWD 16 opposite the bent housing 14. A drillstring 24 has an end connected within the rotating slide sub 18. Referring to FIG. 1, it can be seen that the borehole 20 has a generally curved configuration. This curved configuration is indicative of directional drilling of the well. The bit 12 continues to rotate as the drillstring 24 is lowered into the earth. A rotation of the bit 12 is accomplished by the passing of the drilling fluid to the motor within the bent housing 14. As the motor receives the drilling fluid, the bit 12 is rotated so as to form the borehole 12. The MWD 16 includes conventional MWD components, such as accelerometers and magnetometers. These sensors are capable of measuring the inclination and azimuth of the well bore. Various sensor systems and measurements are carried out so as to properly locate the location of the bit 12 within the hole. Conventionally, the MWD 16 will have suitable telemetry associated with it so as to pass the assessed information to a surface location above the borehole 20.

After the surface location has received the signals concerning the location of the bit 12 within the borehole 20, computations are carried out so as to determine whether the bit 12 is in a proper location during the directional drilling operation. These computations and calculations are necessary so as to assure that the drilling operation proceeds in accordance with the lease. Additionally, proper control over the direction of the bit 12 must be carried out so as to prevent undue contact forces from affecting the speed of drilling. These contact forces can occur anywhere along the well of the borehole 20. These contact forces occur when the drillstring 24, or any component of the bottom hole assembly can contact the side of the borehole 20. When the normal drilling procedure is carried out, there should be minimal contact between the borehole 20 and the drillstring 24. However, under many circumstances, the interior of the borehole 20 is not smooth. In other circumstances, portions of the side wall of the borehole 20 can collapse so as to "clog" the drilling pathway. In certain normal procedures, the drillstring 24 is not rotated but simply slides downwardly through the hole as the bit 12 rotates. When the drillstring 24 slides downwardly through the hole 20, the speed of drilling is reduced proportionately to the amount of contact between the wall of borehole 20 and the surface of the drillstring 24. Often, a buckling of the drillstring 24 will occur when the drillstring 24 is lowered faster than the rate of drilling 12.

Many of these problems can be avoided as long as the drillstring 24 is rotated as the drillstring 24 is lowered within the hole 20. However, whenever the drillstring 24 is rotated, in accordance with prior procedures, the MWD 16 will also rotate. As a result, proper measurements cannot be carried out from the MWD 16. Whenever measurements are necessary, then the drillstring 24 must be stopped so that proper position information can be received from the MWD. Whenever the rotation of the drillstring 24 is stopped, circumstances develop where the rate of drilling and undesirable contact forces result. As such, the rotating slide sub 18 was developed so as to allow the drillstring 24 to continue to rotate within the borehole 20. The rotating slide sub 18 has one end connected to the drillstring 24 and another end connected to the MWD 16. When properly actuated, the sub 18 will allow the drillstring 24 to rotate while the MWD is rotationally stationary. As such, the drillstring 24 can rotate while the MWD 16 can carry out its measurements in a stationary position. Since the MWD 16 is affixed to the motor housing 14, the motor housing 14 will remain stationary whenever the MWD 16 is stationary. When the sub 18 is actuated so as to cause a rotation of the MWD 16, then the motor housing 14 will rotate in correspondence with the rotation of the MWD 16. Under other circumstances, by passing drilling fluid through the interior of the drillstring 24, through the sub 18, and through the MWD 16, the motor within the housing 14 can be properly driven such that the bit 12 will rotate, even though the motor housing 14 and MWD 16 remain stationary.

Figure 2:
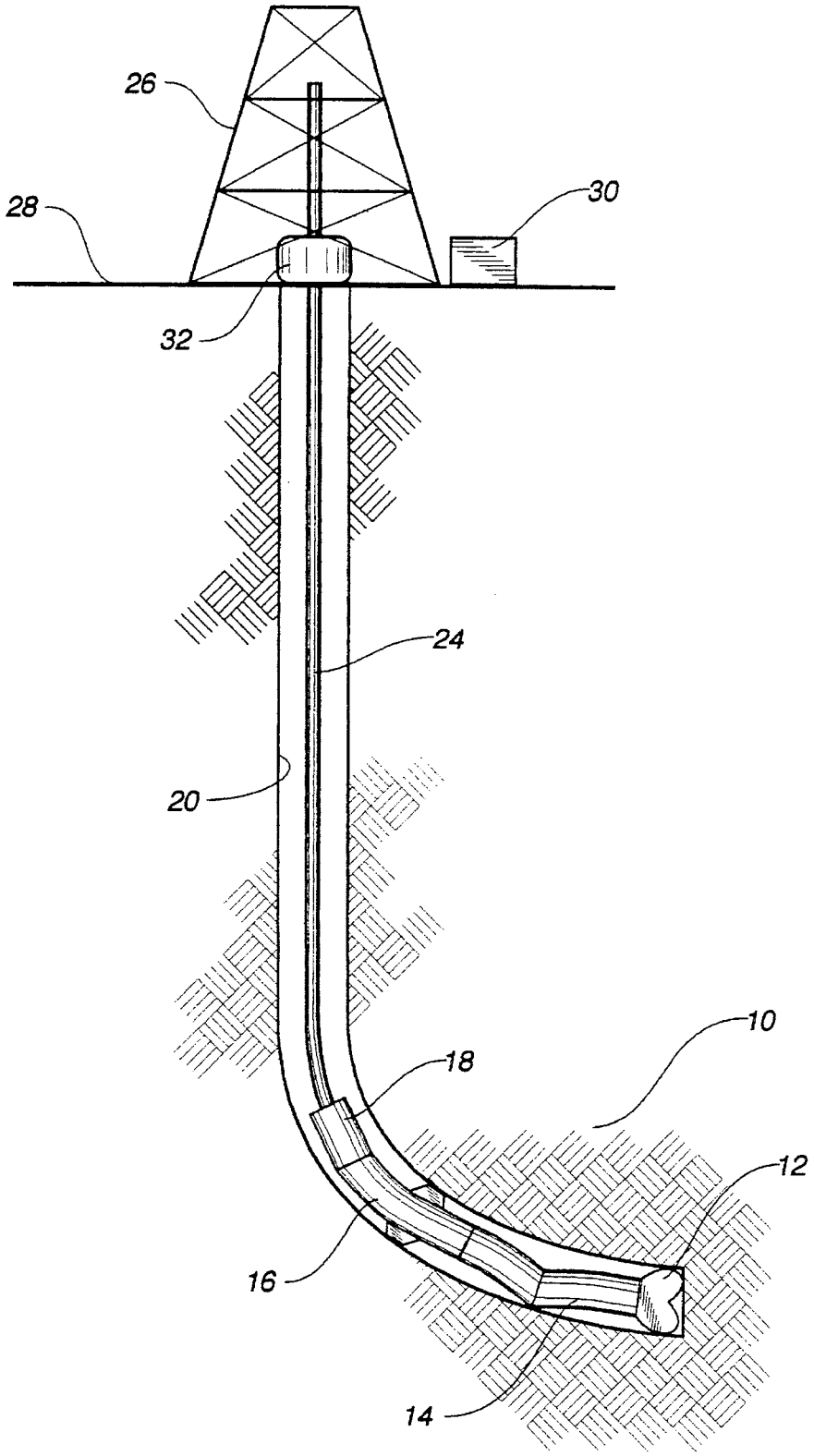
FIG. 2 is an illustration of the configuration of a directional drilling operation employing the method of the present invention.

In FIG. 2, it can be seen that the drilling rig 26 is positioned on the surface 28 of the earth. The processing equipment 30 is also positioned on the surface of the earth 28. Processing equipment 30 receives the signals from the MWD 16 so as to allow for the operator at the surface to properly determine the location of the bit 12 within the borehole 20. The drillstring 24 extends downwardly through the borehole 20 and is received by the sub 18 associated with the bottom hole assembly 10. The drillstring 24 can be rotated through the use of a rotary table 32 located at the surface 28. Suitable hydraulics can be employed, in a conventional manner, with the drillstring 24 so as to allow for the drilling fluid to pass to the motor within the motor housing 14.

Figure 3:
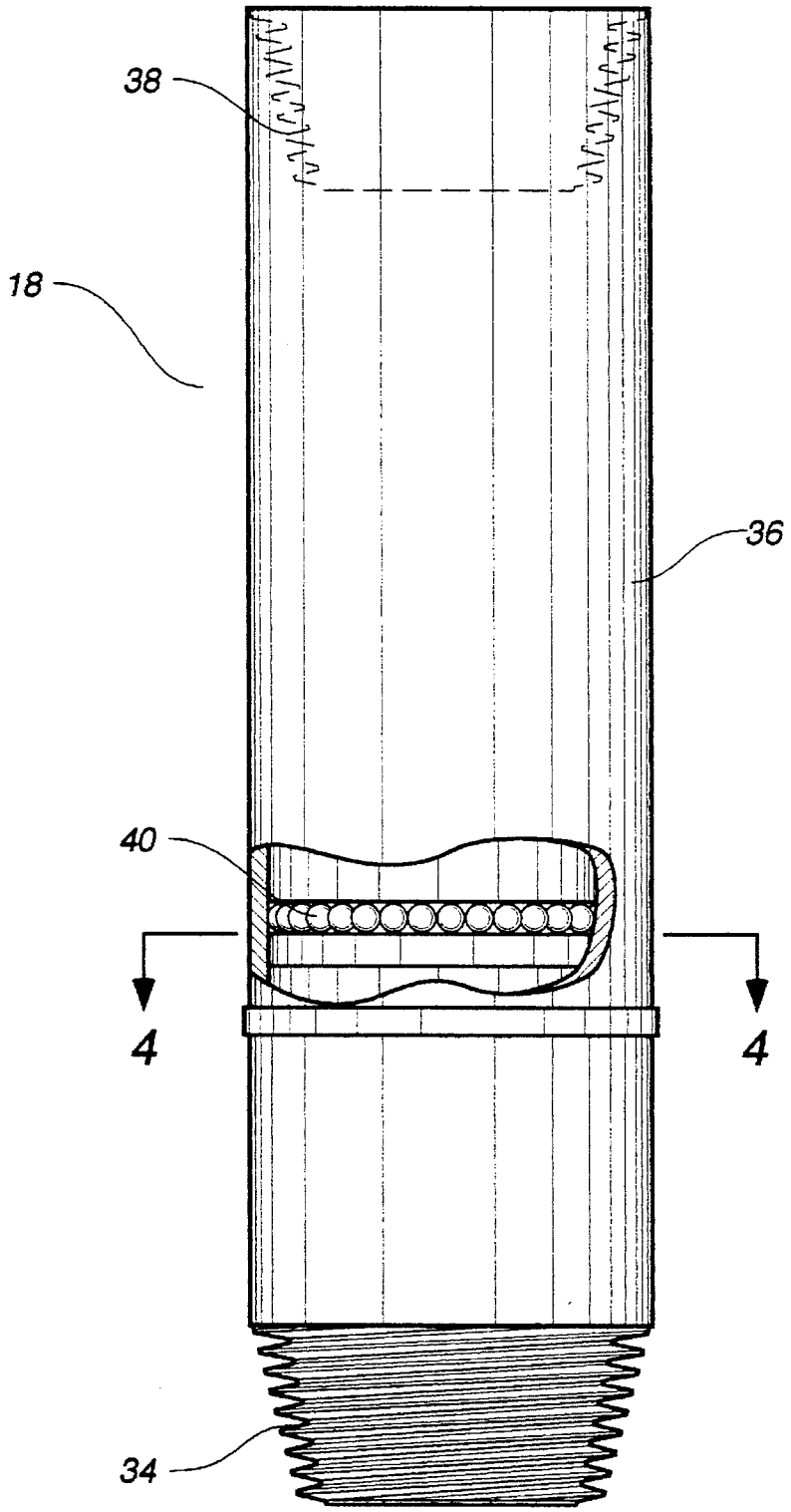
FIG. 3 is an side elevational view of the sub of the method of the present invention.

FIG. 3 is an isolated view of the rotating slide sub 18 of the present invention. It can be seen that the rotating slide sub 18 has a first threaded end 34 of a tapered configuration. This end 34 is suitable for threaded receipt within a corresponding receptacle formed in the MWD collar. The tapered configuration allows for the end 34 to be "stabbed" into this receptacle formed within the MWD collar. The body 36 of the sub 18 is generally cylindrical along its exterior surface. The end 38 includes a threaded receptacle which is suitable for receiving the threaded end of the drillstring 24. The rotating slide sub 18 includes a first interior portion, associated with the end 38 and a second portion which is associated with the threaded end 34. The first portion is connected to the drillstring 24. The second portion is connected to the motor housing. The thrust bearings 40 are provided on the interior of the sub body 36 so as to allow for relative rotations between these portions of the sub 18. As will be described hereinafter, a gear member is located within the interior of the sub 18 so as to allow for selective engagement between these portions associated with the drillstring 24 and with the motor housing 14.

Figure 4:
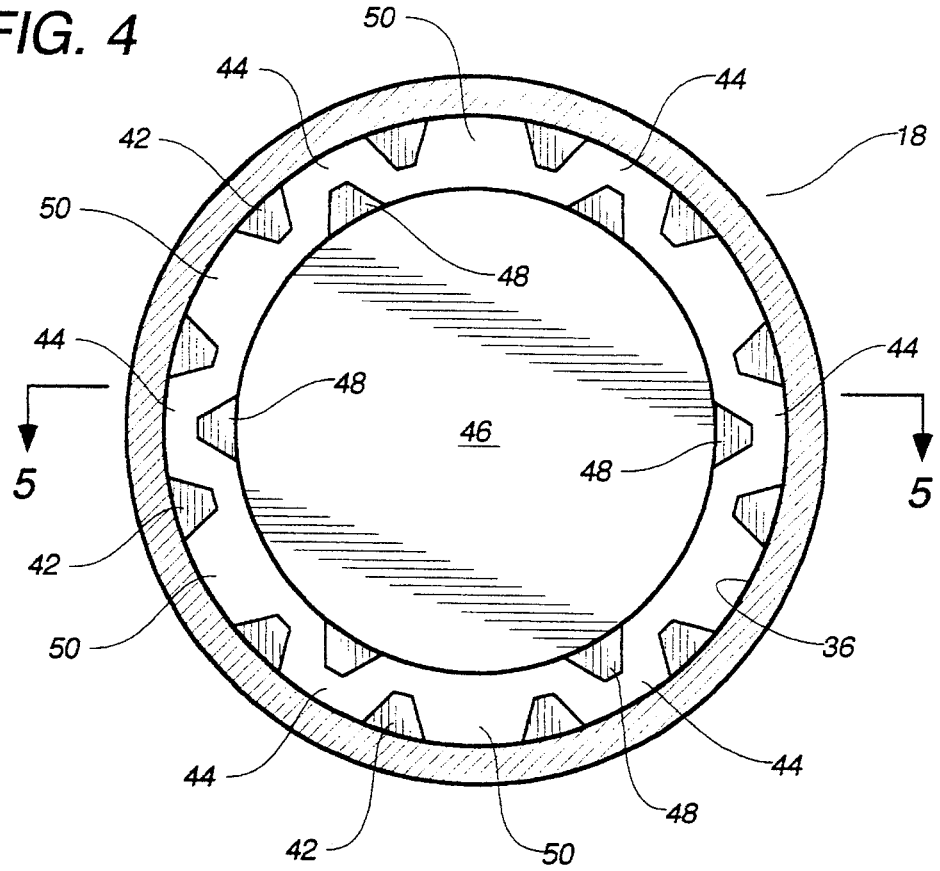
FIG. 4 is a cross-sectional view of the sub as taken across lines 4—4 of FIG. 3.

FIG. 4 shows a cross-sectional view of the interior of the sub 18. It can be seen that a plurality of teeth 42 are formed along the interior diameter of the sub body 36. In particular, these teeth 42 are formed on the interior of the second portion associated with the motor housing 14. The teeth 42 define the opening 44 therebetween. A plate 46 is positioned on the interior of the sub 18 and has teeth 48 extending outwardly therefrom. The teeth 42 also define spaces 50 therebetween. In FIG. 4, it can be seen that the teeth 48 are engaging the spaces 44. In this position of engagement, the first portion will be engaged with the second portion of the sub 18. As such, the MWD will rotate in correspondence with the rotation of the drillstring 24.

When it is desired to actuate the sub 18 such that the MWD 16 is stationary relative to the rotation of the drillstring 24, then the flow of drilling fluid is stopped such that the plate 46 is forced upwardly by a spring and will separate the teeth 48 from their positions within spaces 44. When the teeth 48 raise above the level of the threaded 42, then the MWD 16, and its associated motor housing 14, will be stationary within the hole. At this point in time, measurements can be properly carried out at the MWD 16. The drillstring 24 can continue to rotate, even though the flow of drilling fluid has stopped.

When it is desired to operate the drill bit 12 while the MWD 16 and the motor housing 14 are stationary, then the flow of drilling fluid is started, once again. This flow of drilling fluid will force the plate 46 downwardly such that the teeth 48 will index so as to engage the spaces 50 between gear teeth 42. When the teeth 48 engage the spaces 50, the motor can receive the drilling fluid and the bit 12 will be rotated, even though the MWD 16 and the motor housing 14 are stationary. When it is desired to stop the rotation of the bit 12, then the flow of drilling fluid is stopped so that the plate 46 raises upwardly so as to disengage from the spaces 50. The teeth 48 will then rotate one step so as to be in proper position for engaging the spaces 44 whenever the drilling fluid is passed downwardly once again. As such, the configuration of the sub 18 allows for control of the engagement and disengagement of the sub 18 from the MWD 16 and the drillstring 24.

Figure 5:
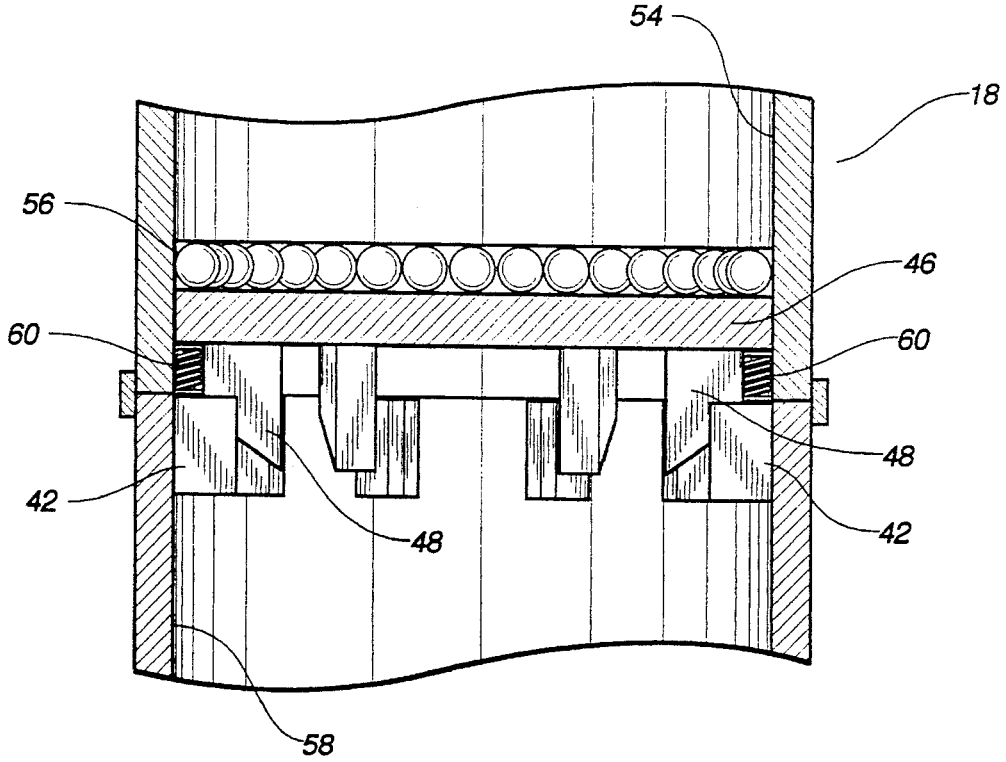
FIG. 5 is a cross-sectional view of the interior of the sub of FIG. 3.

FIG. 5 illustrates a side view of the configuration of the sub 18. In particular, it can be seen that a first portion 54 extends upwardly so as to connect with the drillstring 24. Thrust bearings 56 are formed between the first portion 54 and the second portion 58. As such, the bearings 56, under proper circumstances, allow for relative rotation between the portion 54 and the portion 58. The plate 46 extends across a surface of the second portion 58 and includes teeth 48 extending downwardly. These teeth 48 can engage the teeth 42 extending inwardly of the second portion 58. Springs 60 are positioned along the bottom surfaces of plate 46. The springs 60 serve to resiliently urge the plate 46 upwardly and to rotate the plate 46 slightly in the absence of drilling fluid flow. The springs 60 can have a variety of configurations (such as leaf or coil springs) which impart an angular force on the plate 46 such that the plate rotates slightly as it moves upwardly. When drilling fluid impacts upon the surface of the plate 46, then the force of the drilling fluid will force the plate 46 downwardly such that the teeth 48 engage the teeth 42. When there is no flow of drilling fluid, then the teeth 46 will raise upwardly so as to be free of the teeth 42 and, thusly, allow relative rotation between the portions 54 and 56.

In the present invention, the sub 18 of the bottom hole assembly 10 is placed on the drillstring 24, preferably above the MWD 16. The sub 18 would also be set so as to allow the entire drillstring 24 to be rotated, if desired, by the rotary table or top drive assembly. When it is applicable (due to well conditions or other circumstances), pump pressure, from the drilling fluid, is available so as to enable the sub to be set for the rotation of the drillstring, above the sub, without rotating the drillstring below the sub. The weight of the drillstring is also available so as to allow for the setting of the sub 18. The proper actuation of the sub, in the drillstring, allows for the drillstring to be rotated above the sub without rotating the drillstring below the sub. In directional wellbores, where drillstring sticking may occur, the sub 18 allows for the rotation of the drill pipe while taking surveys. This is accomplished because the direction and inclination package of the MWD is stationary. In wellbores, such as horizontal wells, where steering the borehole (sliding) becomes difficult due to wellbore conditions, it is possible to rotate the entire drillstring so as to set the tool face orientation in the direction desired. The sub 18 can then be set so as to allow the drillstring to be rotated while controlling the tool face orientation through the rotation of the rotary table and/or the surface weight of the drillstring. This serves to minimize the effects of the friction between the drillstring and the wellbore pathway. This allows weight to be transferred to the bit so as to produce a faster rate of penetration and to enable the operator to slide when it is further out in the lateral section. This further enables the steering of the well path for longer lateral sections in the chosen formation.

The sub 18 has been described herein in one particular form. It is important to note that the present invention describes the "method" for the directional drilling operation. This method generally employs the use of the sub, described herein previously. However, it is noted that various configurations of such subs can be employed within the concept of the present invention. For example, rather than the use of gear members, various other techniques, such as lock-and-key, magnets, electromagnetic, or other configurations can occur. As such, the method of the present invention should not be restricted to the specific configuration of the rotating slide sub as described herein.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A method of directional drilling comprising:

affixing a bit and a motor housing and an MWD and a sub to an end of a drillstring;

forming a hole in the earth by rotating said bit as said drill string lowers into the earth;

actuating said sub such that said MWD is stationary as said drillstring rotates; and measuring a position of said bit as said MWD is stationary and said drillstring rotates.

2. The method of claim 1, said step of affixing comprising:

attaching said motor housing and said MWD to said drillstring such that said MWD rotates in correspondence with said motor housing.

3. The method of claim 2, said bit connected to a motor within said motor housing, said method further comprising:

pumping a drilling fluid to said motor through said drillstring; and rotating said bit relative to a flow of drilling fluid in said drillstring.

4. The method of claim 1, said step of forming further comprising:

rotating said drillstring as said drillstring lowers into the earth.

5. The method of claim 1, said step of actuating comprising:

disengaging a portion of said sub from said drillstring such that said portion is stationary when said drillstring rotates, said portion being connected to said MWD.

6. The method of claim 5, said step of disengaging comprising:

stopping a flow of drilling fluid through said drillstring.

7. The method of claim 1, said step of actuating comprising:

rotating said bit as said MWD and said motor housing are stationary.

8. The method of claim 1, said step of measuring comprising:

measuring an inclination and an azimuth of the hole at the location of said MWD in the hole.

9. The method of claim 1, further comprising:

transmitting a position of said bit to a surface location.

10. The method of claim 9, further comprising:

adjusting a tool face orientation relative to the position of the bit with the hole.

11. The method of claim 10, further comprising:

reactuating said sub such that said MWD rotates with a rotation of said drillstring.

12. The method of claim 1, said sub having a first portion connected to said drillstring and a second portion connected to said motor housing, said step of actuating comprising:

indexing a gear member within said sub such that said first portion rotates independently of said second portion.

13. The method of claim 12, said step of actuating further comprising:

indexing said gear member within said sub such that said second portion is stationary as said first portion and said bit rotate.

14. The method of claim 13, said step of indexing comprising:

pumping a drilling fluid into contact with a plate within said sub, said plate movable between a first gear-engaging position and a second non-engagement position, said first portion rotating independently of said second portion in said second position, said first portion rotating with said second portion in said first position, said pumping moving said plate to said first position.

15. A method of taking measurements during directional drilling comprising:

attaching a sub between an MWD and a drillstring, said sub having a first portion connected to said drillstring and a second portion connected to said MWD;

actuating said sub such that said MWD is stationary as said drillstring rotates;

measuring position information with said MWD as said drillstring rotates and as said MWD is stationary; and transmitting said position information to a location remote from said MWD.

16. The method of claim 15, said step of attaching further comprising:

affixing a motor housing to said MWD, said motor housing containing a bit motor, said bit motor connected to a bit.

17. The method of claim 16, said step of actuating further comprising:

actuating said sub such that said bit rotates as said MWD is stationary.

18. The method of claim 15, further comprising:

adjusting a tool face orientation relative to a position of the bit within the hole.

19. The method of claim 18, further comprising:

reactuating said sub such that said MWD rotates with a rotation of said drillstring.

20. The method of claim 17, further comprising:

pumping a drilling fluid to said motor through said drillstring; and rotating said bit relative to a flow of said drilling fluid in said drillstring.

* * * * *